US008421329B2

(12) United States Patent
Liang et al.

(10) Patent No.: US 8,421,329 B2
(45) Date of Patent: Apr. 16, 2013

(54) LUMINAIRE HAVING LIGHT-EMITTING ELEMENTS DISPOSED ON PROTRUSIONS

(75) Inventors: Chih-Lung Liang, Taipei (TW); Shu-Hua Yang, Taipei (TW); Chin-Ming Cheng, Taipei (TW); Jui-Lin Tsai, Taipei (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 32 days.

(21) Appl. No.: 13/158,903

(22) Filed: Jun. 13, 2011

(65) Prior Publication Data

US 2012/0043878 A1 Feb. 23, 2012

Related U.S. Application Data

(60) Provisional application No. 61/375,350, filed on Aug. 20, 2010.

(30) Foreign Application Priority Data

Jan. 6, 2011 (CN) ..... 2011 1 0005182

(51) Int. Cl.
*H01J 5/48* (2006.01)

(52) U.S. Cl.
USPC ..... 313/317; 362/235

(58) Field of Classification Search ..... 313/317; 362/235
See application file for complete search history.

(56) References Cited

U.S. PATENT DOCUMENTS

2010/0254133 A1* 10/2010 Cheng ..... 362/235
2011/0026253 A1 2/2011 Gill
2011/0215696 A1* 9/2011 Tong et al. ..... 313/46

FOREIGN PATENT DOCUMENTS

JP 2005-208396 A 8/2005

* cited by examiner

*Primary Examiner* — Tracie Y Green
(74) *Attorney, Agent, or Firm* — Rosenberg, Klein & Lee

(57) ABSTRACT

A luminaire includes a lamp holder, a lamp cover and a plurality of first light-emitting modules. The lamp holder has a top surface, a plurality of protrusions protruding upwardly from the top surface. Each of the protrusions has an inclined surface. The lap cover is connected to the lamp holder, and covers the top surface and the inclined surfaces. Each of the first light-emitting modules includes a first light-emitting element. The view angle of the luminaire can be increased due to disposition of the first light-emitting elements on the inclined surfaces of the protrusions. Furthermore, since the first light-emitting elements are disposed on the protrusions, heat can be dissipated easily from the first light-emitting elements.

18 Claims, 6 Drawing Sheets

LUMINAIRE HAVING LIGHT-EMITTING ELEMENTS DISPOSED ON PROTRUSIONS

CROSS-REFERENCE TO RELATED APPLICATION

This application claims priority of U.S. provisional application No. 61/375,350, filed on Aug. 20, 2010, and Chinese Application No. 201110005182.8, filed on Jan. 6, 2011.

BACKGROUND OF THE INVENTION

1. Field of the Invention

This invention relates to a luminaire, and more particularly to a luminaire capable of increasing the view angle.

2. Description of the Related Art

Although LEDs (light emitting diodes) have the advantages of low power consumption and high efficiency, the view angle thereof is limited. As a result, when LEDs are employed in a luminaire (such as a bulb) to serve as light sources, the view angle of the luminaire is also limited.

SUMMARY OF THE INVENTION

The object of this invention is to provide a luminaire capable of increasing the view angle.

Accordingly, the luminaire of this invention includes a lamp holder, a lamp cover and a plurality of first light-emitting modules. The lamp holder has a top surface, and a plurality of protrusions protruding upwardly from the top surface. Each of the protrusions has an inclined surface. The lamp cover is connected to the lamp holder, and covers the top surface and the inclined surfaces of the protrusions. The first light-emitting modules are disposed on the inclined surfaces of the protrusions.

The luminaire of this invention has an effect in that, due to disposition of the first light-emitting modules on the inclined surfaces of the protrusions, the view angle of the luminaire can be increased. Furthermore, since the first light-emitting elements are disposed on the protrusions, heat can be dissipated easily from the first light-emitting modules.

BRIEF DESCRIPTION OF THE DRAWINGS

These and other features and advantages of this invention will become apparent in the following detailed description of three preferred embodiments of this invention, with reference to the accompanying drawings, in which.

DETAILED DESCRIPTION OF THE PREFERRED EMBODIMENTS

Figure 1:
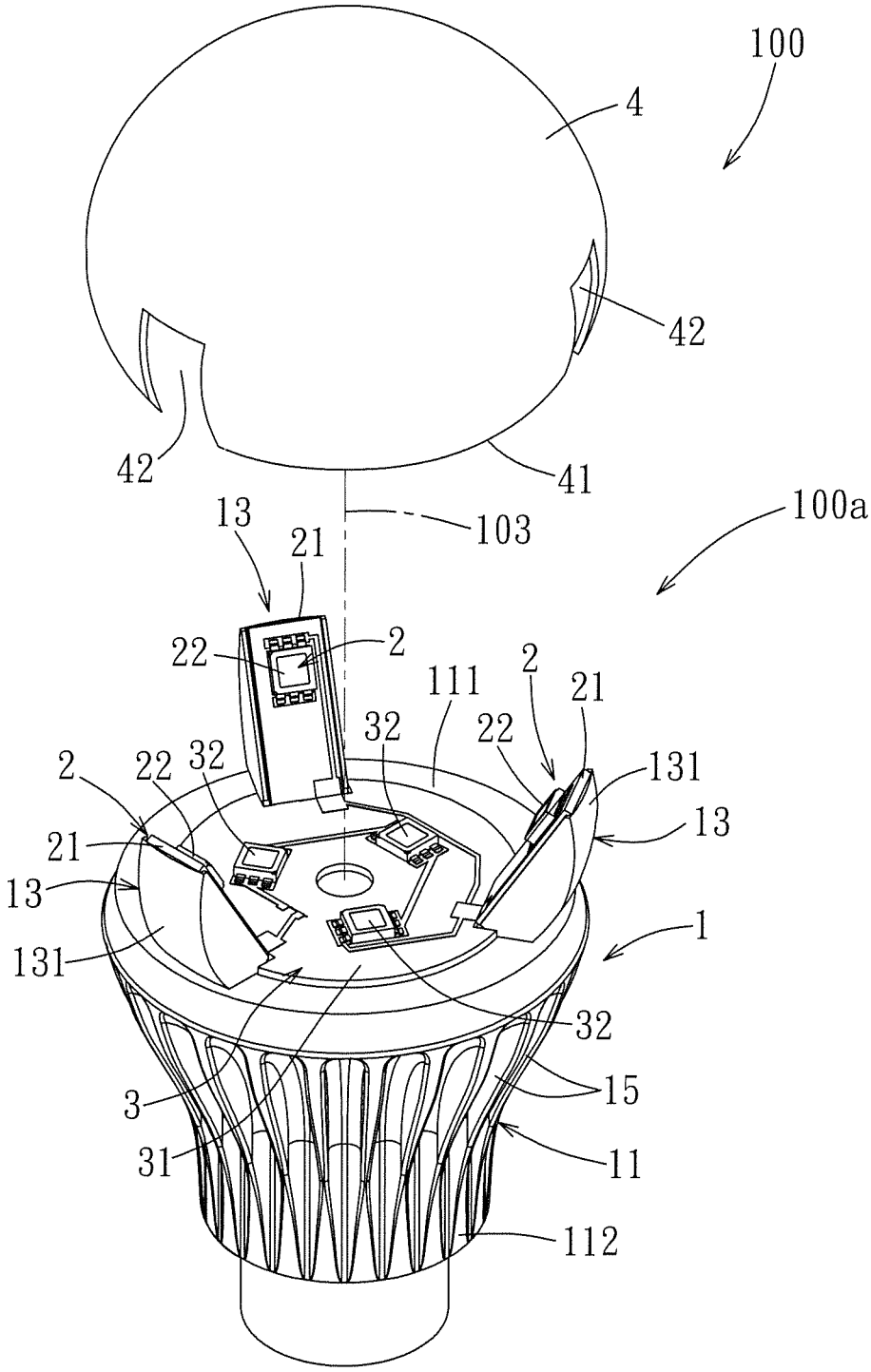
FIG. 1 is a partly exploded perspective view of the first preferred embodiment of a luminaire according to this invention.

Before the present invention is described in greater detail in connection with the preferred embodiments, it should be noted that similar elements and structures are designated by like reference numerals throughout the entire disclosure.

Figure 2:
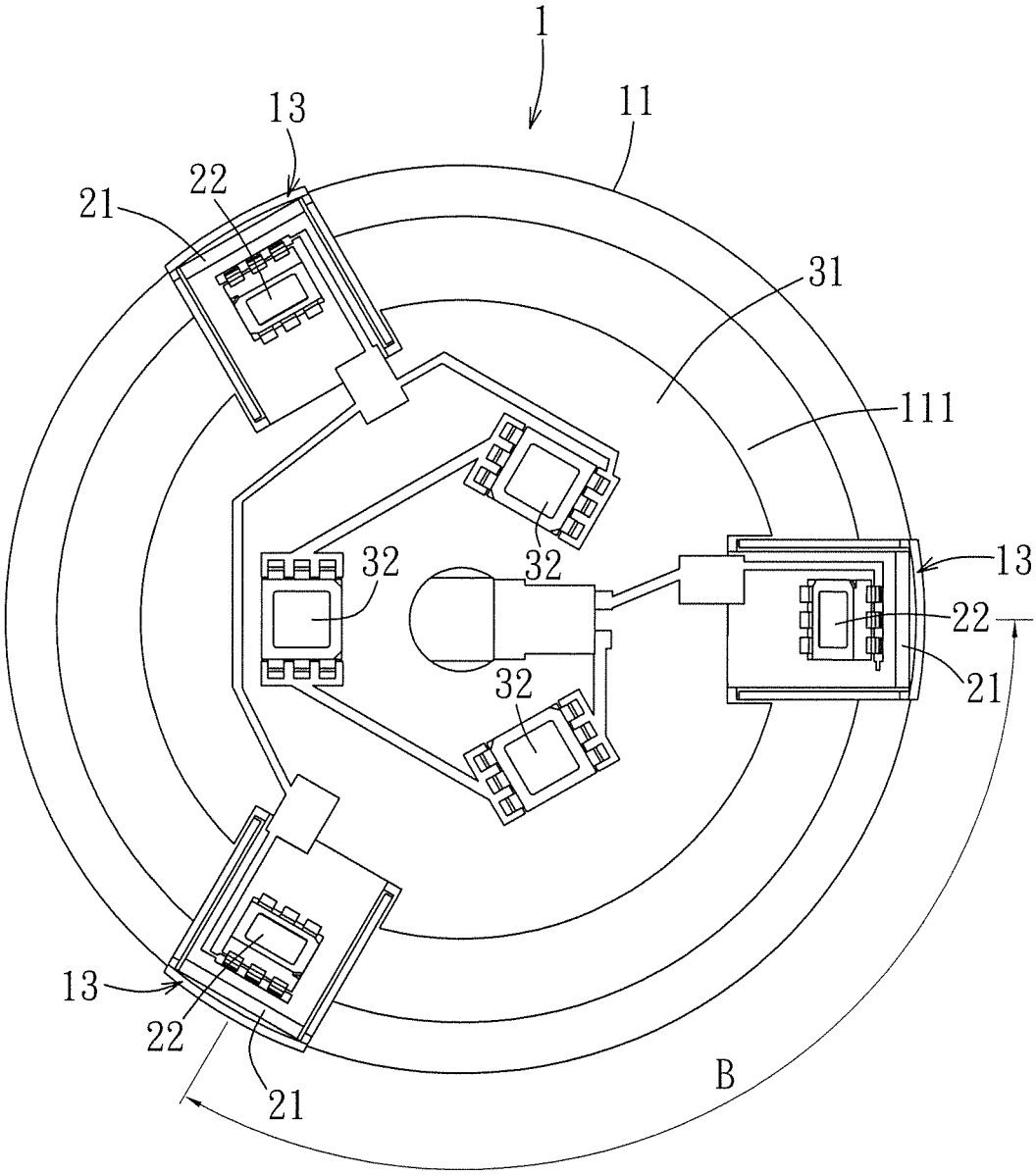
FIG. 2 is a fragmentary top view of the first preferred embodiment.
Figure 3:
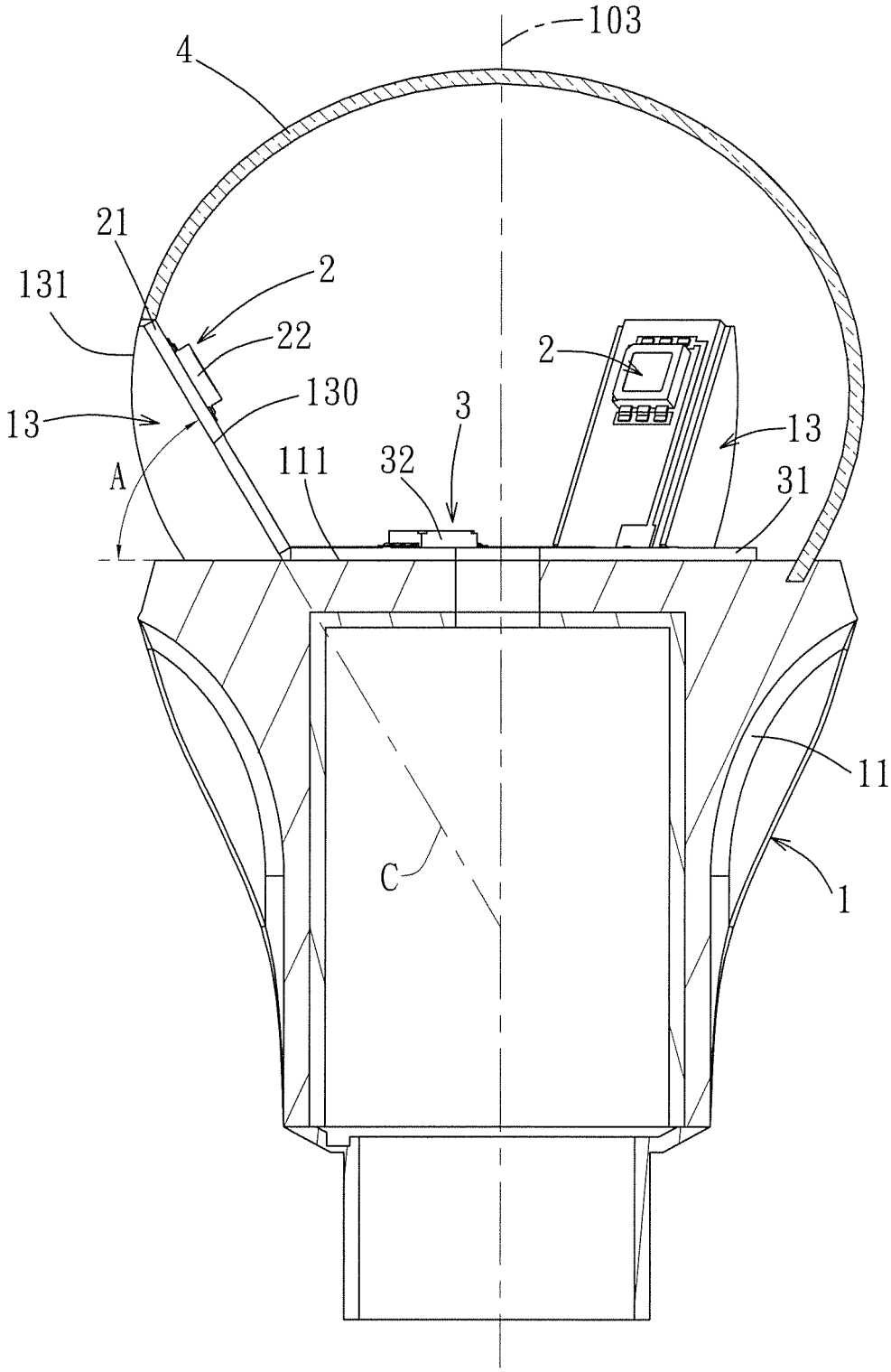
FIG. 3 is a sectional view of the first preferred embodiment.

Referring to FIGS. 1, 2, and 3, the first preferred embodiment of a luminaire 100 according to this invention includes a lamp holder module 100*a*, a plurality of first light-emitting modules 2, and a second light-emitting module 3.

The lamp holder module 100*a* includes a lamp holder 1 and a lamp cover 4. The lamp holder 1 includes a holder body 11 and a plurality of protrusions 13. The holder body 11 has a top surface 111, an outer peripheral surface 112 extending downwardly from an outer periphery of the top surface 111, a central axis 103 extending uprightly through the top surface 111, and a plurality of heat-dissipating fins 15 formed on the outer peripheral surface 112. In this embodiment, the number of the protrusions 13 is but not limited to three. For example, the number of the protrusions 13 may be two, four, or five. The protrusions 13 are disposed around the central axis 103, and are angularly equidistant. That is, in this embodiment, any two adjacent protrusions 13 are spaced apart from each other by a radial angle (B) (see FIG. 2) of 120 degrees. Each of the protrusions 13 has an inclined surface 130 and a back surface 131 opposite to the inclined surface 130. Each of the inclined surfaces 130 of the protrusions 13 extends upwardly in a direction away from the central axis 10, and forms an angle of 120 degrees with respect to a central portion of the top surface 111, and an angle (A) (see FIG. 3) of 60 degrees with respect to an outer peripheral portion of the top surface 111 disposed thereunder. The extension line (C) (see FIG. 3) of each of the inclined surfaces 130 forms an angle of 30 degrees with respect to the central axis 103. In this embodiment, the inclined surfaces 130 are flat, and the back surfaces 131 are curved.

Figure 4:
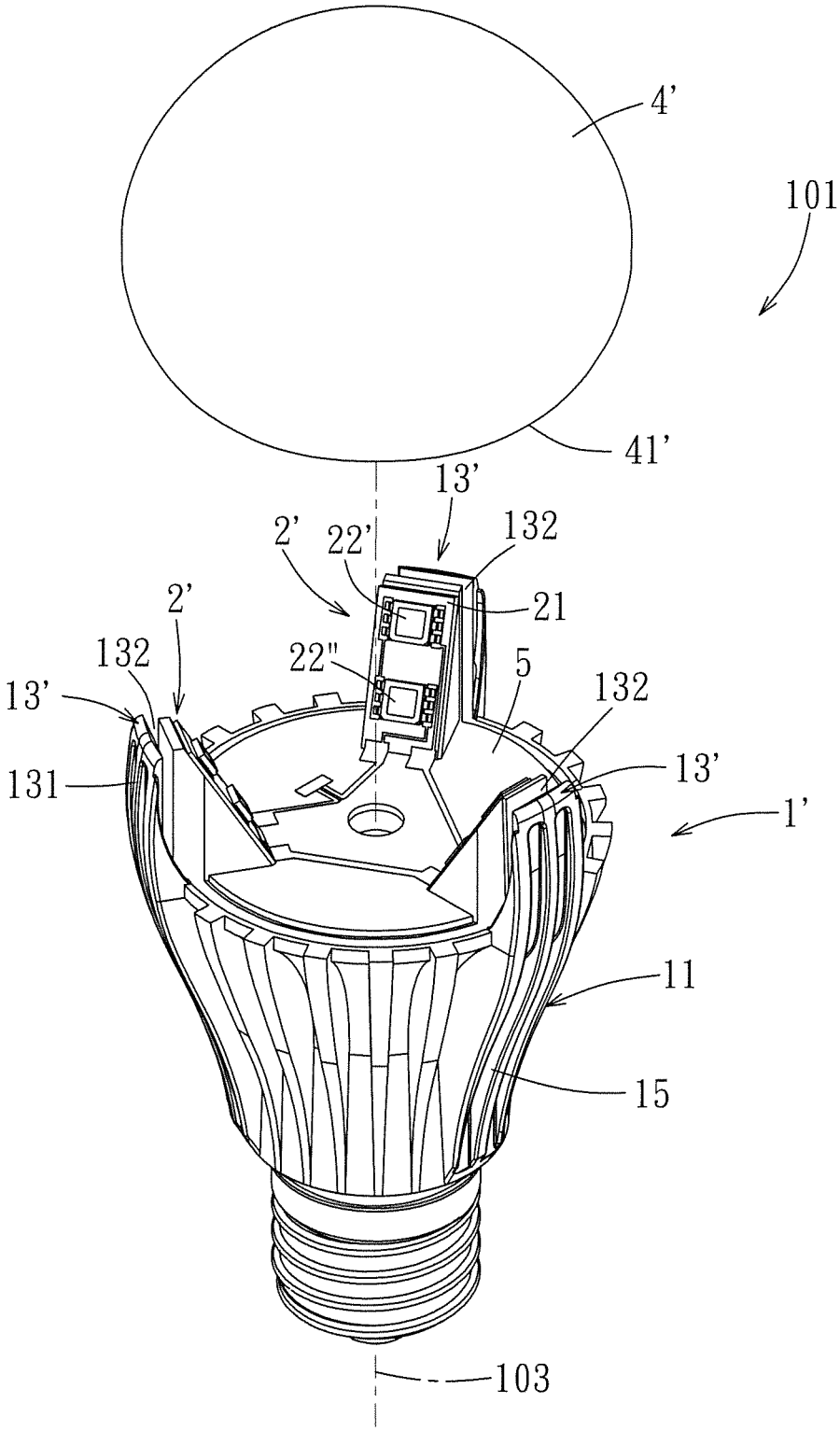
FIG. 4 is a partly exploded perspective view of the second preferred embodiment of a luminaire according to this invention.

In this embodiment, the protrusions 13 are made of metal, and extend upwardly from the holder body 11 and formed on the outer periphery of the top surface 111, as shown in FIG. 1. In other embodiments, portions of the protrusions 13 can be disposed to extend integrally and upwardly from the heat-dissipating fins 15, and located along the outer periphery of the top surface 111, as shown in FIG. 4.

In this embodiment, the first light-emitting modules 2 are disposed respectively on the inclined surfaces 130 of the protrusions 13. Each of the first light-emitting modules 2 includes a first circuit board 21 disposed on the inclined surface 130 of the corresponding protrusion 13, and a first light-emitting element 22 disposed on the first circuit board 21. The second light-emitting module 3 includes a second circuit board 31 and a plurality of second light-emitting elements 32 disposed on the second circuit board 31. In this embodiment, each of the first and second light-emitting elements 22 is configured as an LED.

In this embodiment, the number of the second light-emitting elements 32 is three, and any two adjacent second light-emitting elements 32 are angularly equidistant. Each of the second light-emitting elements 32 is disposed between angular positions of two adjacent protrusions 13. In other words, the first light-emitting elements 22 are arranged alternately with the second light-emitting elements 32. As such, the optical axis of each of the first light-emitting elements 22 does not cross with the optical axes of any two adjacent second light-emitting elements 32. That is, the optical axis of each of the first light-emitting elements 22 and the optical axes of any two adjacent second light-emitting elements are staggered. In this embodiment, the second light-emitting elements 32 and the protrusions 13 are disposed around the central axis 103, in such a manner that the protrusions 13 are farther away from the central axis 103 than the second light-emitting elements 32. In this manner, the amount of lateral light transmitted out of the luminaire 100 is increased to thereby enlarge the view angle of the luminaire 100.

Ratio of the total luminous flux of the second light-emitting elements 32 disposed on the top surface 111 to that of the first light-emitting elements 22 disposed on the inclined surfaces 130 is 1:1. That is, the value of total lumens of the first light-emitting elements 22 is equal to that of the second light-emitting elements 32 to attain an optimal light distribution curve.

The lamp cover 4 is connected to the lamp holder 1, and covers the top surface 111 of the holder body 11 and the inclined surfaces 130. In this embodiment, the lamp cover 4 is in the form of a truncated hollow sphere, and has an open bottom end. The lamp cover 4 has a bottom edge 41 that is formed with a plurality of notches 42. The number of the notches 42 corresponds to that of the protrusions 13 of the holder body 11. The profile of each of the notches 42 is complementary to that of the corresponding protrusion 13. The lamp cover 4 has diffusing grains therein for reducing the hotspot effect, so that a substantial reduction in the lighting effect can be avoided.

The protrusions 13 are inserted into the notches 42, respectively, such that the top surface 111 of the holder body 11 and the inclined surfaces 130 of the protrusions 13 are covered by the lamp cover 4 and the back surfaces 131 of the protrusions 13 are exposed outwardly of the lamp holder 1 and the lamp cover 4.

Preferably, the lamp cover 4 has a maximum diameter at a height position thereof that is spaced apart from the top surface 111 of the lamp holder 1 by a distance that is between one half and one third of a distance between a top end of the lamp cover 4 and the top surface 111 of the lamp holder 1. That is, a portion of the lamp cover 4 having the maximum diameter is located between one half and one third of the height of the lamp cover 4. Also preferably, any point of a portion of the lamp cover 4 having the maximum diameter is at an angle smaller than 30 degrees with respect to an optical axis of the corresponding first light-emitting element 22 (i.e. the angle is within a range between 30° and −30° of the optical axis of the corresponding first light-emitting element 22) to maximize the view angle of the luminaire 100.

According to a test result, due to disposition of the first light-emitting modules 2 on the inclined surfaces 130 of the protrusions 13, as compared to a conventional luminaire provided with light-emitting modules on only a top surface of a lamp holder, the view angle is increased from 120 degrees to 155 degrees, and the temperature of LED chips of the light-emitting elements is reduced from 78 centigrade degrees centigrade to 72.8 degrees centigrade. To further improve the lighting efficiency of the luminaire 100, reflecting plates (not shown) can be disposed on the top surface 111 of the lamp holder 1.

As such, light is emitted from each of the second light-emitting elements 32 in an upward direction and from each of the first light-emitting modules 2 in an inclined direction, so that the view angle of the luminaire 100 is increased. Furthermore, since the first light-emitting elements 22 are arranged alternately with the second light-emitting elements 32, light interference occurring therebetween can be avoided. Further, the back surfaces 131 of the protrusions 13 are exposed outwardly of the lamp cover 4 to facilitate dissipation of heat from the first light-emitting modules 2.

Figure 5:
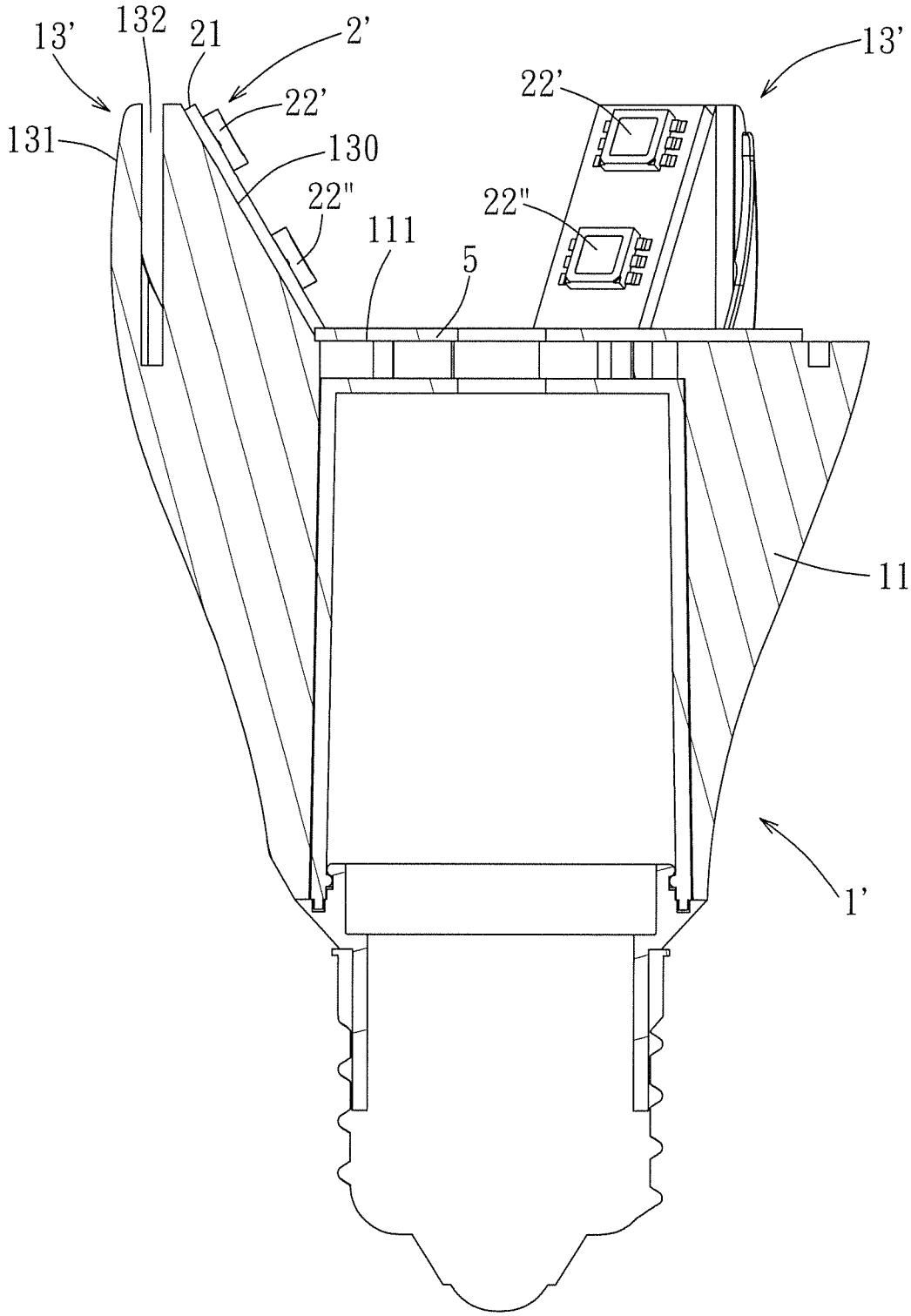
FIG. 5 is a fragmentary sectional view of the second preferred embodiment.

With further reference to FIGS. 4 and 5, the second preferred embodiment of a luminaire 101 according to this invention is similar in construction to the first preferred embodiment. The main difference is described in the following. The protrusions 13' extend integrally and upwardly from the heat-dissipating fins 15. Each of the protrusions 13' further has an insert groove 132 formed between the inclined surface 130 and the back surface 131. The bottom edge 41' of the lamp cover 4' is not formed with any notches 42 (see FIG. 1), and is inserted into the insert grooves 132 in the protrusions 13 in such a manner that, the inclined surfaces 130 of the protrusions 13' and the top surface 111 of the holder body 11 are covered by the lamp cover 4', and the back surfaces 131 of the protrusions 13' are exposed outwardly of the lamp cover 4' to facilitate heat dissipation.

In this embodiment, each of the first light-emitting modules 2' includes a pair of upper and lower first light-emitting elements 22', 22" disposed on the inclined surface 130 of the corresponding protrusion 13' and arranged one above the other. There are not any light-emitting modules disposed on the top surface 111 of the lamp holder 1', and only one a second circuit board 5 is disposed on the same so as to establish an electrical connection among the first light-emitting modules 2'. The second circuit board 5 may be replaced with reflecting plates.

The lower first light-emitting elements 22" are spaced apart from the top surface 111 of the lamp holder 1' by a vertical distance of 6 mm. The upper first light-emitting elements 22' are spaced apart from the top surface 111 of the lamp holder 1' by a vertical distance of 13 mm. As such, the optical efficiency is higher than 80%. In other words, the second light-emitting module 3 (see FIG. 3) is optional. If desired, the top surface 111 of the lamp holder 1' may be further provided with reflecting plates (not shown).

According to a test result, since each of the first light-emitting modules 2' includes the pair of upper and lower first light-emitting elements 22', 22", as compared to the conventional luminaire having light-emitting modules on a top surface of a lamp holder, the view angle is increased from 120 degrees to 180 degrees, and the temperature of the LED chips of the light-emitting elements are reduced from 78 degrees centigrade to 73 degrees centigrade. Alternatively, the lamp holder module including the lamp holder 1' and the lamp cover 4' may be combined with the first and second light emitting modules 2, 3 of the first preferred embodiment to constitute a luminaire, which can achieve effects similar to those of the first preferred embodiment.

Figure 6:
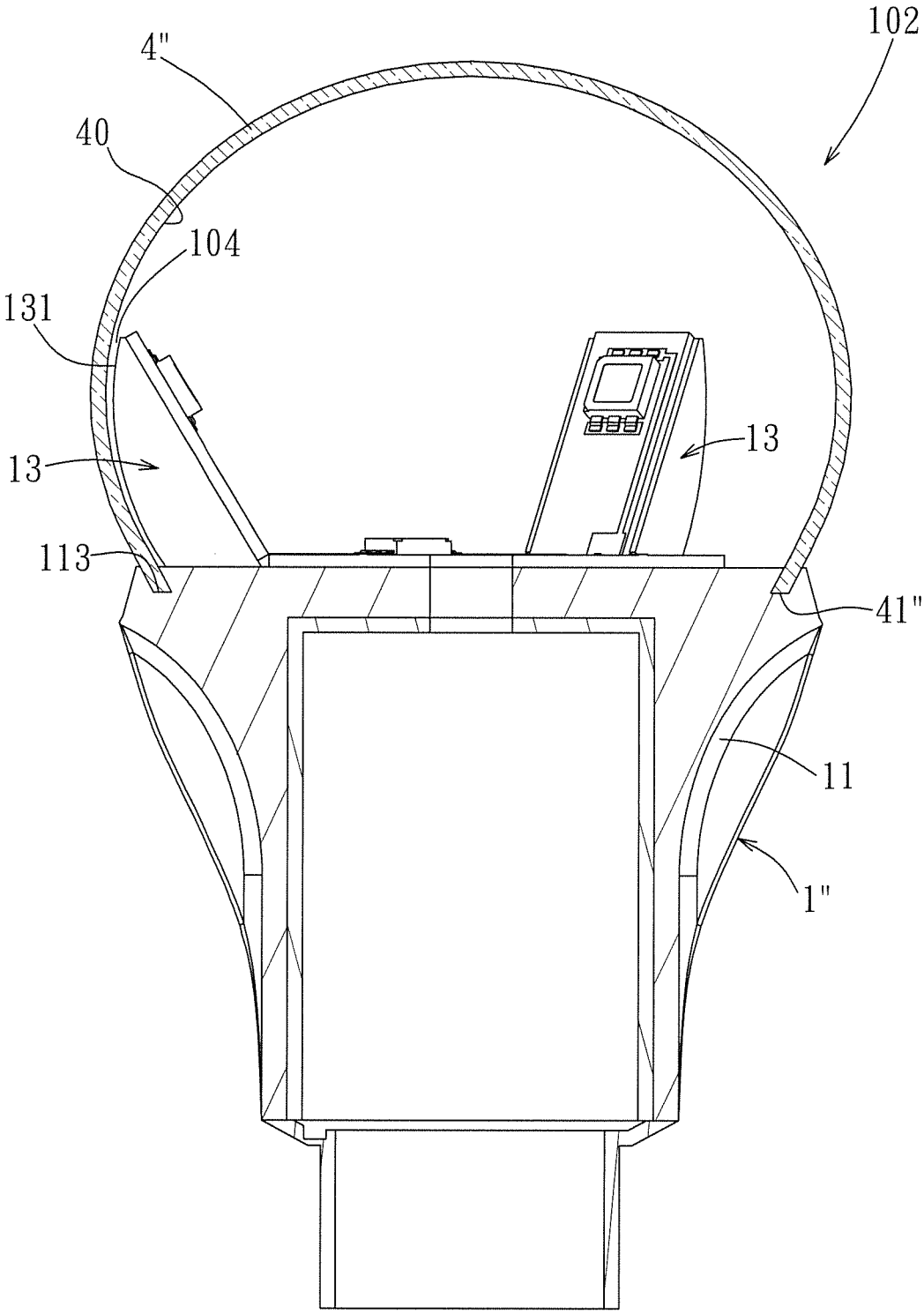
FIG. 6 is a sectional view of the third preferred embodiment of a luminaire according to this invention.

With further reference to FIG. 6, the third preferred embodiment of a luminaire 102 according to this invention is similar in construction to that of the second preferred embodiment. In this embodiment, the whole protrusions 13 are covered by the lamp cover 4". In other words, the back surfaces 131 of the protrusions 13 are covered by the lamp cover 4", and are not exposed outwardly of the lamp cover 4", in such a manner that an inner surface 40 of the lamp cover 4" is spaced apart from each of the back surfaces 131 of the protrusions 13 by a clearance 104 to facilitate heat dissipation.

Preferably, the top surface 111 of the holder body 11 is formed with an annular groove 113 disposed around the protrusions 13 and permitting the bottom edge 41 of the lamp cover 4" to be inserted therein. Alternatively, the lamp cover 4" may be connected to the lamp holder 1" in other similar manners. The connection between the lamp cover 4" and the lamp holder 1" may be applied to the first preferred embodiment to interconnect the lamp cover 4 and the lamp holder 1.

In the above preferred embodiments, since the first light-emitting modules 2, 2' are disposed on the inclined surfaces 130 of the protrusions 13, 13', heat dissipation area is increased and hot sources are dispersed so as to facilitate heat dissipation. Furthermore, in this manner, light contacts less interfaces, so that Fresnel loss is low. As a consequence, the optical efficiency is higher than 80%.

It should be noted that, the inclination angle of the inclined surfaces 130 of the protrusions 13, 13' can be changed to adjust the view angle. That is, the view angle can be adjusted by changing the inclination angle of the inclined surfaces 130 or the positions of the first and second light-emitting modules 2, 2', 3 relative to the lamp cover 4, 4', 4", thereby increasing the applicable range of the luminaire 100, 101, 102.

In view of the above, since the first light-emitting modules 2, 2' are disposed on the inclined surfaces 130 of the protrusions 13, 13', the view angle of the luminaire 100, 101, 102 can be increased considerably. Thus, the object of this invention is achieved. Furthermore, in the first and second preferred embodiments, due to exposure of the back surfaces 131 of the protrusions 13, 13', heat can be dissipated easily from the protrusions 13, 13'.

With this invention thus explained, it is apparent that numerous modifications and variations can be made without departing from the scope and spirit of this invention. It is therefore intended that this invention be limited only as indicated by the appended claims.

We claim:

1. A luminaire comprising:

a lamp holder having a top surface, and a plurality of protrusions protruding upwardly from said top surface, each of said protrusions having an inclined surface;

a lamp cover connected to said lamp holder and covering said top surface and said inclined surfaces of said protrusions;

a plurality of first light-emitting modules disposed on said inclined surfaces of said protrusions; and a second light-emitting module disposed on said top surface of said lamp holder, each of said first light-emitting modules including a first light-emitting element, said second light-emitting module including a plurality of second light-emitting elements;

wherein any two adjacent ones of said protrusions are spaced apart from each other by a radial angle, each of said second light-emitting elements being disposed between angular positions of two adjacent ones of said protrusions.

2. The luminaire as claimed in claim 1, wherein each of said first and second light elements of said first and second light-emitting modules is configured as an LED.

3. The luminaire as claimed in claim 1, wherein an optical axis of each of said first light-emitting elements of said first light-emitting modules and optical axes of two adjacent ones of said second light-emitting elements are staggered.

4. The luminaire as claimed in claim 1, wherein said first light-emitting elements of said first light-emitting modules are arranged alternately with said second light-emitting elements.

5. The luminaire as claimed in claim 1, wherein each of said first light-emitting elements of said first light-emitting modules is configured as an LED.

6. The luminaire as claimed in claim 1, wherein said lamp holder has a central axis extending uprightly through said top surface, said inclined surfaces of said protrusions facing said central axis.

7. The luminaire as claimed in claim 1, wherein said protrusions are disposed around a central axis extending uprightly through said top surface and are angularly equidistant.

8. The luminaire as claimed in claim 1, wherein said lamp holder has a central axis extending uprightly through said top surface, said inclined surface of each of said protrusions extending upwardly in a direction away from said central axis.

9. A luminaire comprising:

a lamp holder having a top surface, and a plurality of protrusions protruding upwardly from said top surface, each of said protrusions having an inclined surface and a back surface, said back surface being opposite to said inclined surface;

a lamp cover connected to said lamp holder and covering said top surface and said inclined surfaces of said protrusions, said back surface being exposed outwardly of said lamp cover and said lamp holder; and a plurality of light-emitting modules disposed on said inclined surfaces of said protrusions.

10. The luminaire as claimed in claim 9, wherein each of said protrusions further has an insert groove formed between said inclined surface and back surface and permitting insertion of said lamp cover therein.

11. The luminaire as claimed in claim 9, wherein said lamp cover has a bottom edge, and a plurality of notches formed in said bottom edge, said protrusions being inserted into said notches, respectively.

12. The luminaire as claimed in claim 9, wherein said back surface is spaced apart from said lamp cover.

13. The luminaire as claimed in claim 12, wherein an inner surface of said lamp cover is spaced apart from each of said back surfaces of said protrusions by a clearance.

14. A luminaire comprising:

a lamp holder having a top surface, and a plurality of protrusions protruding upwardly from said top surface, each of said protrusions having an inclined surface;

a lamp cover connected to said lamp holder and covering said top surface and said inclined surfaces of said protrusions, said lamp cover having a maximum diameter at a height position thereof that is spaced apart from said top surface of said lamp holder by a distance that is between one half and one third of a distance between a top end of said lamp cover and said top surface of said lamp holder; and a plurality of first light-emitting modules disposed on said inclined surfaces of said protrusions.

15. The luminaire as claimed in claim 14, wherein said lamp cover has a maximum diameter at a portion thereof, each point of which is at an angle smaller than 30 degrees with respect to an optical axis of a corresponding one of said first light-emitting elements.

16. The luminaire as claimed in claim 14, further comprising a second light-emitting module disposed on said top surface of said lamp holder.

17. The luminaire as claimed in claim 14, wherein each of said first light-emitting modules includes at least two light-emitting elements arranged one above the other.

18. The luminaire as claimed in claim 1, wherein each of said protrusions further has a back surface opposite to said inclined surface and that is spaced apart from said lamp cover.

* * * * *